US007286106B2

(12) United States Patent
Komiya et al.

(10) Patent No.: US 7,286,106 B2
(45) **Date of Patent: *Oct. 23, 2007**

(54) IMAGE DISPLAY DEVICE, DISPLAY PANEL AND DRIVING METHOD THEREOF

(75) Inventors: Naoaki Komiya, Suwon-si (KR); Jin-Tae Jung, Suwon-si (KR)

(73) Assignee: Samsung SDI Co., Ltd., Suwon-si (KR)

( * ) Notice: Subject to any disclaimer, the term of this patent is extended or adjusted under 35 U.S.C. 154(b) by 0 days.

This patent is subject to a terminal disclaimer.

(21) Appl. No.: 10/953,014

(22) Filed: Sep. 28, 2004

(65) Prior Publication Data

US 2005/0104815 A1 May 19, 2005

(30) Foreign Application Priority Data

Nov. 13, 2003 (KR) ..... 10-2003-0080280

(51) Int. Cl.
*G09G 3/32* (2006.01)

(52) U.S. Cl. ..... 345/82; 345/76; 345/204; 315/169.3

(58) Field of Classification Search ..... 345/76–83, 345/87–103, 208–210, 204–205; 315/169.1, 315/169.3; 348/800–803
See application file for complete search history.

(56) References Cited

U.S. PATENT DOCUMENTS 5,426,447 A 6/1995 Lee
5,510,807 A 4/1996 Lee et al.
5,686,936 A 11/1997 Maekawa et al.
5,708,454 A 1/1998 Katoh et al.
6,229,506 B1 5/2001 Dawson et al.
6,229,508 B1 * 5/2001 Kane ..... 345/82
6,362,798 B1 3/2002 Kimura et al.
6,369,786 B1 * 4/2002 Suzuki ..... 345/77

(Continued)

FOREIGN PATENT DOCUMENTS

CN 1361510 A 7/2002

(Continued)

OTHER PUBLICATIONS

European Search Report for Application No. EP 03 00 6113; Jan. 18, 2004, 2 pages.

*Primary Examiner*—Lun-Yi Lao
(74) *Attorney, Agent, or Firm*—Christie, Parker & Hale, LLP

(57) ABSTRACT

A display panel of an image display device including data lines for transmitting data voltages representing image signals, scan lines for transmitting select signals, and pixel circuits coupled to the data and scan lines. The pixel circuit includes a driver for outputting a current corresponding to a data voltage applied from the data line, and a display element for displaying an image corresponding to an amount of the current outputted by the driver. A first switch transmits the data voltage to the driver in response to a select signal, and a second switch transmits a precharge voltage to the driver in response to a first control signal. The value of the precharge voltage during a period in which the first control signal is applied to the second switch is different from the value of the precharge voltage during other periods.

20 Claims, 7 Drawing Sheets

U.S. PATENT DOCUMENTS

| | | | | |
|---|---|---|---|---|
| 6,469,318 | B2 | 10/2002 | Yamada et al. | |
| 6,501,448 | B1 | 12/2002 | Komiya et al. | |
| 6,580,408 | B1 | 6/2003 | Bae et al. | |
| 6,650,060 | B2 | 11/2003 | Okuda | |
| 6,731,266 | B1 | 5/2004 | Jung | |
| 6,760,005 | B2 * | 7/2004 | Koyama et al. | 345/98 |
| 6,791,129 | B2 | 9/2004 | Inukai | |
| 6,809,482 | B2 | 10/2004 | Koyama | |
| 6,989,826 | B2 * | 1/2006 | Kasai | 345/204 |
| 7,015,884 | B2 | 3/2006 | Kwon | |
| 2002/0047581 | A1 | 4/2002 | Koyama | |
| 2002/0118150 | A1 | 8/2002 | Kwon | |
| 2003/0179164 | A1 * | 9/2003 | Shin et al. | 345/76 |
| 2004/0041769 | A1 * | 3/2004 | Yamashita et al. | 345/93 |
| 2004/0217925 | A1 | 11/2004 | Chung et al. | |

FOREIGN PATENT DOCUMENTS

| | | | |
|---|---|---|---|
| EP | 0 905 673 | A1 | 3/1999 |
| EP | 1 220 191 | A2 | 7/2002 |
| EP | 1 220 191 | A3 | 9/2003 |
| JP | 02082295 | A | 3/1990 |
| JP | 2002-351401 | | 12/2002 |

* cited by examiner

IMAGE DISPLAY DEVICE, DISPLAY PANEL AND DRIVING METHOD THEREOF

CROSS REFERENCE TO RELATED APPLICATION

This application claims priority to and the benefit of Korea Patent Application No. 2003-80280 filed on Nov. 13, 2003 in the Korean Intellectual Property Office, the entire content of which is incorporated herein by reference.

BACKGROUND OF THE INVENTION (a) Field of the Invention

The present invention relates to an image display device, display panel, and driving method thereof. More specifically, the present invention relates to an organic electroluminescent (EL) display device.

(b) Description of the Related Art

The organic EL display device, which is a display device for electrically exciting a fluorescent organic compound to emit light, has organic light-emitting cells that are voltage- or current-driven to display an image. These organic light-emitting cells have, as shown in FIG. 1, a structure composed of an anode (indium tin oxide (ITO)) layer, an organic thin film, and a cathode (metal) layer. For a good balance between electrons and holes to enhance luminescent efficiency, the organic thin film has a multi-layer structure that includes an emitting layer (EML), an electron transport layer (ETL), and a hole transport layer (HTL). The multi-layer structure of the organic thin film may also include an electron injecting layer (EIL) and a hole injecting layer (HIL).

There are two driving methods for these organic light-emitting cells: one is a passive matrix driving method and the other is an active matrix driving method using thin film transistors (TFTs). In the passive matrix driving method, anode and cathode electrodes are arranged perpendicular to each other to selectively drive the lines. On the other hand, in the active matrix driving method, a thin film transistor and a capacitor are coupled to ITO pixel electrodes so as to sustain a voltage by the capacity of the capacitor. According to the form of the signals applied to the capacitor to sustain the voltage, the active matrix driving method can be divided into a voltage programming method and a current programming method.

The voltage programming method is for displaying an image by applying a data voltage representing gradation to the pixel circuit, but this method has a non-uniformity problem due to a deviation of the threshold voltage of the driving transistor and the electron mobility. The current programming method is for displaying an image by applying a data current representing gradation to the pixel circuit, guaranteeing uniformity, but this method is problematic in securing the time for charging the load of the data lines since only a small amount of current is used in controlling the organic EL element.

A pixel circuit for compensating for the threshold voltage of the driving transistor in the voltage programming method is disclosed in U.S. Pat. No. 6,362,798, for example.

The pixel circuit disclosed in U.S. Pat. No. 6,362,798 includes, as shown in FIG. 2, four transistors M1 to M4, and an organic EL element (OLED). The driving transistor M1 transfers a current corresponding to a voltage between its gate and source to the OLED. A capacitor Cst is connected between the gate and the source of the driving transistor M1. The transistor M2 is diode-connected and has a gate coupled to the gate of the transistor M1. The switching transistor M3 transmits the data voltage applied to the data line Dm to the transistor M2 in response to the select signal provided by a current scan line Sn, and the switching transistor M4 transmits a precharge voltage Vp to the transistor M2 in response to the select signal provided by a previous scan line Sn-1.

In the conventional pixel circuit shown in FIG. 2, the transistor M2 has the same characteristic as that of the transistor M1 such that the deviation of the threshold voltage of the transistor M1 is compensated. Further, the precharge voltage is appropriately established, and the transistor M2 is coupled in the forward direction.

However, the conventional pixel circuit has a problem of current leakage through the transistor M4 because of the precharge voltage Vp when a high level select signal is applied to the previous scan line Sn-1 to turn off the transistor M4. Accordingly, images with desired gray levels are not displayed because of the current leakage, and unnecessary power consumption is generated in the image display device since the current caused by the precharge voltage is consecutively leaked in the pixel circuit while the precharge operation is not being performed.

SUMMARY OF THE INVENTION

In an exemplary embodiment of the present invention, is provided a display panel without current leakage caused by a precharge voltage, and an image display device.

In another exemplary embodiment of the present invention, is provided a driving method for accurately representing gray scales of the image display device with a data voltage, and reducing unnecessary power consumption.

In one aspect of the present invention, is provided a display panel of an image display device including a plurality of data lines for transmitting data voltages which represent image signals, a plurality of scan lines for transmitting select signals, and a plurality of pixel circuits coupled to the data lines and the scan lines.

Each said pixel circuit includes a driver for outputting a current corresponding to a corresponding said voltage applied from a corresponding said data line, and a display element for displaying an image corresponding to an amount of the current outputted by the driver. A first switch transmits the corresponding said data voltage to the driver in response to a corresponding said select signal applied from a corresponding said scan line, and a second switch transmits a precharge voltage to the driver in response to a first control signal. A value of the precharge voltage during a period in which the first control signal is applied to the second switch is different from the value of the precharge voltage during other periods.

The driver may include a driving transistor, coupled between a power source and the display element, for outputting the current to the display element in correspondence to the corresponding said data voltage applied to a gate, a compensation transistor, coupled between the first switch and the second switch, being diode-connected, and having a gate coupled to the gate of the driving transistor, and a capacitor coupled between the gate and a source of the driving transistor.

The driving transistor and the compensation transistor may have substantially the same characteristics.

The pixel circuit may further include a third switch for substantially electrically isolating the driver from the display element in response to a second control signal.

The second and third switches may include different channel type transistors, and the first and second control signals may be substantially the same.

The first control signal may be another said select signal applied to a previous said scan line of the corresponding said scan line coupled to the pixel circuit.

The precharge voltage may have a voltage level which is lower than the lowest level of the corresponding said data voltage during the period in which the first control signal is applied.

The precharge voltage may have a value between the lowest level and the highest level of the corresponding said data voltage during a period in which the first control signal is not applied.

The precharge voltage may be a mean value of the corresponding said data voltage.

In another aspect of the present invention, an image display device includes a plurality of pixel circuits. Each said pixel circuit includes a driving circuit for outputting a current corresponding to a corresponding one of a plurality of data voltages, and a display element for displaying an image corresponding to an amount of the current outputted by the driver circuit. A first switch transmits the corresponding one of the data voltages to the driving circuit in response to a corresponding one of a plurality of select signals applied from a corresponding one of a plurality of scan lines, and a second switch transmits a corresponding one of a plurality of precharge voltages to the driving circuit in response to a first control signal. A data driver supplies the plurality of data voltages to the pixel circuits, a scan driver supplies the plurality of select signals to the pixel circuits, and a precharge driver supplies the plurality of precharge voltages to the pixel circuits, wherein each said precharge voltage has at least two levels.

In still another aspect of the present invention, is provided a method for driving an image display device with a pixel circuit including a driving transistor having a first electrode and a second electrode. A capacitor is between the first and second electrodes, and a current which corresponds to a voltage charged in the capacitor is output from a third electrode. A display element displays an image in correspondence to an amount of the current output by the driving transistor. A precharge voltage is transmitted to the first electrode of the driving transistor in response to a first control signal during a first period, and a data voltage is transmitted to the first electrode of the driving transistor in response to a second control signal during a second period, wherein the precharge voltage has a voltage level in the first period which is different from the voltage level in the second period.

In yet another aspect of the present invention, an image display device including a plurality of pixel circuits is provided. Each said pixel circuit includes a display element for emitting light corresponding to an amount of current applied thereto. A driving transistor coupled between a power source and the display element provides the current to the display element corresponding to a data voltage applied to a gate, and a capacitor is coupled between the gate of the driving transistor and the power source. A switching transistor provides a data voltage to the gate of the driving transistor in response to a current select signal applied to its gate, and a diode-connected compensation transistor is coupled between the switching transistor and a precharge voltage source and has a gate coupled to the gate of the driving transistor. A precharge transistor is coupled between the compensation transistor and the precharge voltage source, and applies a precharge voltage to the gate of the driving transistor in response to a previous select signal. The precharge voltage has a first value while the precharge transistor is turned on, which is different from a second value of the precharge voltage while the precharge transistor is turned off.

BRIEF DESCRIPTION OF THE DRAWINGS

The accompanying drawings, together with the specification, illustrate exemplary embodiments of the present invention, and, together with the description, serve to explain the principles of the present invention.

DETAILED DESCRIPTION

In the following detailed description, only certain exemplary embodiments of the present invention are shown and described, simply by way of illustration. As those skilled in the art would realize, the described embodiments may be modified in various different ways, all without departing from the spirit or scope of the present invention. Accordingly, the drawings and description are to be regarded as illustrative in nature, and not restrictive.

Figure 3:
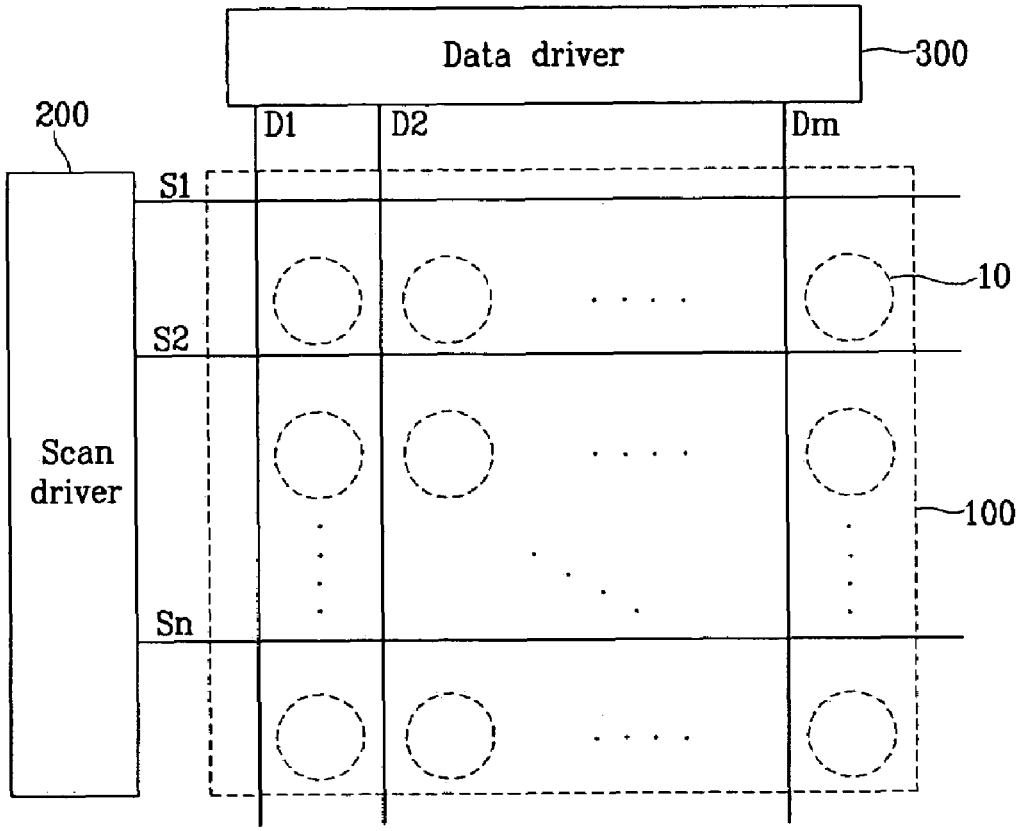
FIG. 3 shows an organic EL display device according to an exemplary embodiment of the present invention.

As shown in FIG. 3, an organic EL display device according to an exemplary embodiment of the present invention includes an organic EL display panel 100, a scan driver 200, and a data driver 300.

The organic EL display panel 100 includes a plurality of data lines D1 to Dm arranged in columns, a plurality of scan lines S1 to Sn arranged in rows, and a plurality of pixel circuits 10. The data lines D1 to Dm each transmit a data voltage representing an image signal to the pixel circuits 10. The scan lines S1 to Sn each transmit a select signal for selecting a row of pixel circuits 10 to the pixel circuits 10. Each pixel circuit 10 is formed in a pixel area defined by two adjacent data lines D1 to Dm and two adjacent scan lines S1 to Sn.

The scan driver 200 sequentially applies the select signal to the scan lines S1 to Sn, and the data driver 300 applies the data voltage representing an image signal to the data lines D1 to Dm.

The scan driver 200 and/or the data driver 300 can be coupled to the display panel 100, or mounted in the form of a chip on a tape carrier package (TCP) that is coupled to the display panel 100 by soldering. The scan driver 200 and/or the data driver 300 can also be mounted in the form of a chip on a flexible printed circuit (FPC) or a film coupled to the display panel by soldering. Alternatively, the scan driver 200 and/or the data driver 300 can be mounted directly on the glass substrate of the display panel, or replaced by the driving circuit formed of the same layers as scan and data lines and thin film transistors on the glass substrate.

Next, the pixel circuit 10 of the organic EL display panel according to an exemplary embodiment of the present invention will be described in detail with reference to FIGS. 4 and 6.

Figure 4:
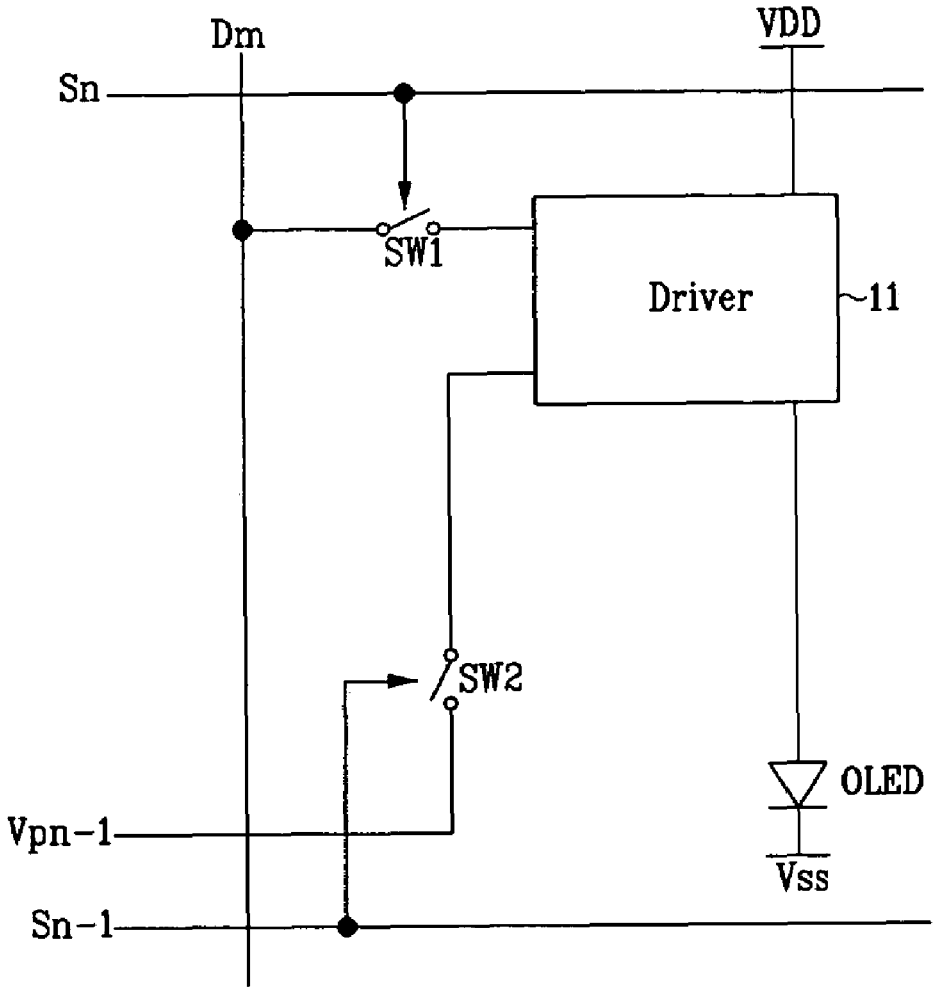
FIG. 4 shows a brief circuit diagram of a pixel circuit according to an exemplary embodiment of the present invention.

For illustrative purposes, FIG. 4 only shows a pixel circuit coupled to the $m^{th}$ data line Dm and the $n^{th}$ scan line Sn. The term "current scan line" as used herein refers to a scan line for transmitting a current select signal, and the term "previous scan line" as used herein refers to a scan line for transmitting a select signal (i.e., a previous select signal) prior to the current select signal.

As shown in FIG. 4, the pixel circuit includes an organic EL element OLED, a driver 11 for driving the organic EL element, and switches SW1 and SW2. The driver 11 receives a power supply voltage VDD.

The organic EL element is a display element for emitting light in correspondence to an amount of the applied current, and has an anode coupled to the driver 11 and a cathode coupled to a power supply voltage VSS. In the exemplary embodiment, the power supply voltage VSS supplies a voltage which has a voltage level lower than that of the power supply voltage VDD. By way of example, the power supply voltage VSS may be a ground voltage.

The driver 11 supplies a current corresponding to the data voltage to the organic EL element OLED. The driver 11 will be described in more detail later.

The switch SW1 is coupled between the data line Dm and the driver 11, and transmits the data voltage to the driver 11 in response to a select signal provided by the current scan line Sn.

The switch SW2 is coupled between a precharge voltage Vpn-1 and the driver 11, and transmits the precharge voltage Vpn-1 to the driver 11 in response to a select signal provided by the previous scan line Sn-1.

The voltage value of the precharge voltage Vpn-1 coupled to one electrode of the switch SW2 in an interval for turning on the switch SW2 is different from the voltage value of the precharge voltage Vpn-1 in an interval for turning off the switch SW2. Hence, the leakage current is prevented from flowing to the driver 11, and unneeded power consumption is reduced because of the precharge voltage Vpn-1 while the switch SW2 is turned off and no precharge voltage Vpn-1 is transmitted to the driver 11.

Figure 5:
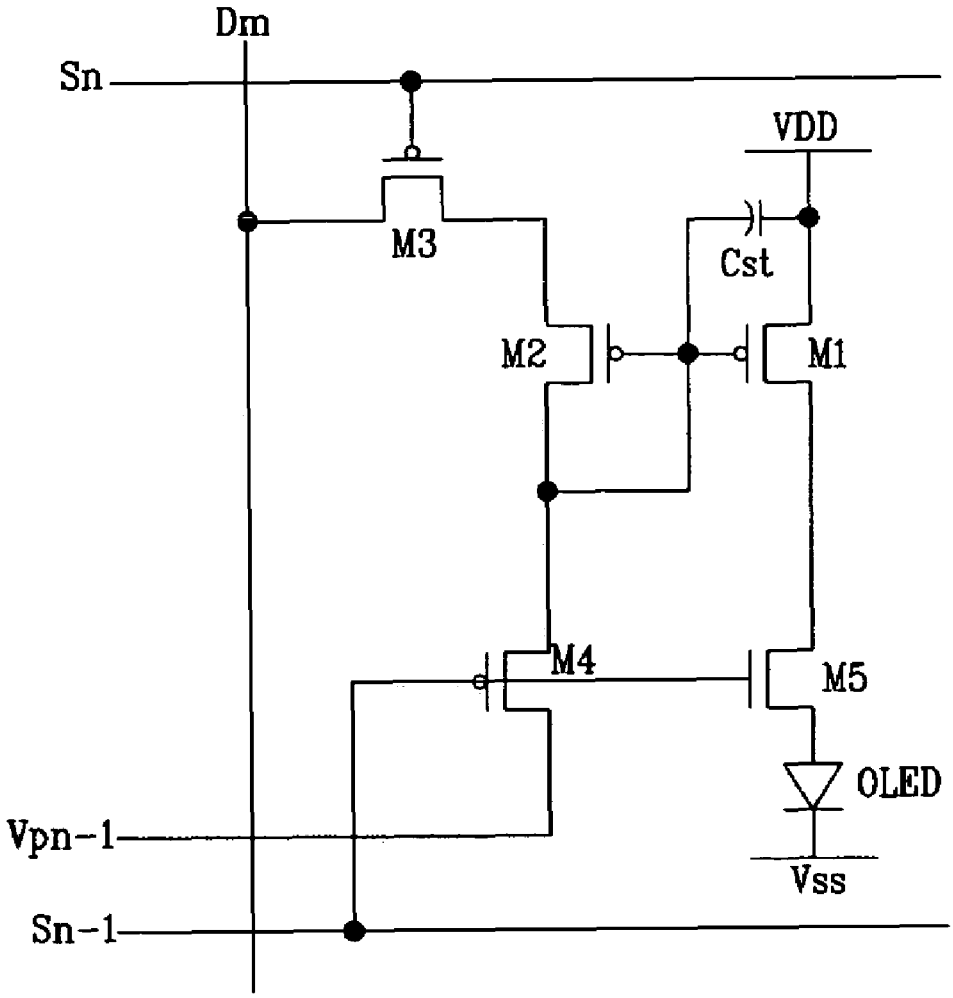
FIG. 5 shows a detailed circuit diagram of the pixel circuit shown in FIG. 4.

As shown in FIG. 5, the switches SW1 and SW2 include transistors M3 and M4, respectively, and the driver 11 includes transistors M1 and M2 and a capacitor Cst.

The transistor M1 coupled between the power supply voltage VDD and the organic EL element OLED outputs the current which corresponds to the voltage applied to the gate to the organic EL element OLED. In detail, when the transistor M1 is a P-type transistor, a source of the transistor M1 is coupled to the power supply voltage VDD, and a drain thereof is coupled to the anode of the organic EL element.

The transistor M2 is a compensation transistor for compensating for the deviation of the threshold voltage of the transistor M1, and has a gate which is coupled to the gate of the transistor M1 and is diode-connected, a source thereof being coupled to the drain of the transistor M3, and a drain thereof being coupled to the source of the transistor M4.

The capacitor Cst is coupled between the source and the gate of the transistor M1, and maintains the gate-source voltage of the transistor M1 for a predetermined time.

The driver 11 further includes a switching transistor M5 coupled between the drain of the driving transistor M1 and the anode of the organic EL element OLED. In this instance, the transistor M5 substantially electrically isolates the drain of the transistor M1 from the anode of the organic EL element in response to the select signal provided by the previous scan line Sn-1. In other embodiments, the transistor M5 may not be used.

In FIG. 5, the transistors M1 and M2 are realized with P-type transistors, but the scope of the exemplary embodiment of the present invention is not restricted to the specific channel type, and can also be realized by using various types of transistor elements which include a first electrode, a second electrode, and a third electrode, and that control the current which flows to the third electrode from the second electrode according to the voltage applied to the first electrode. Further, the switching transistors M3, M4, and M5 can be realized with various types of switches for switching two accessed terminals in response to applied control signals.

Figure 6:
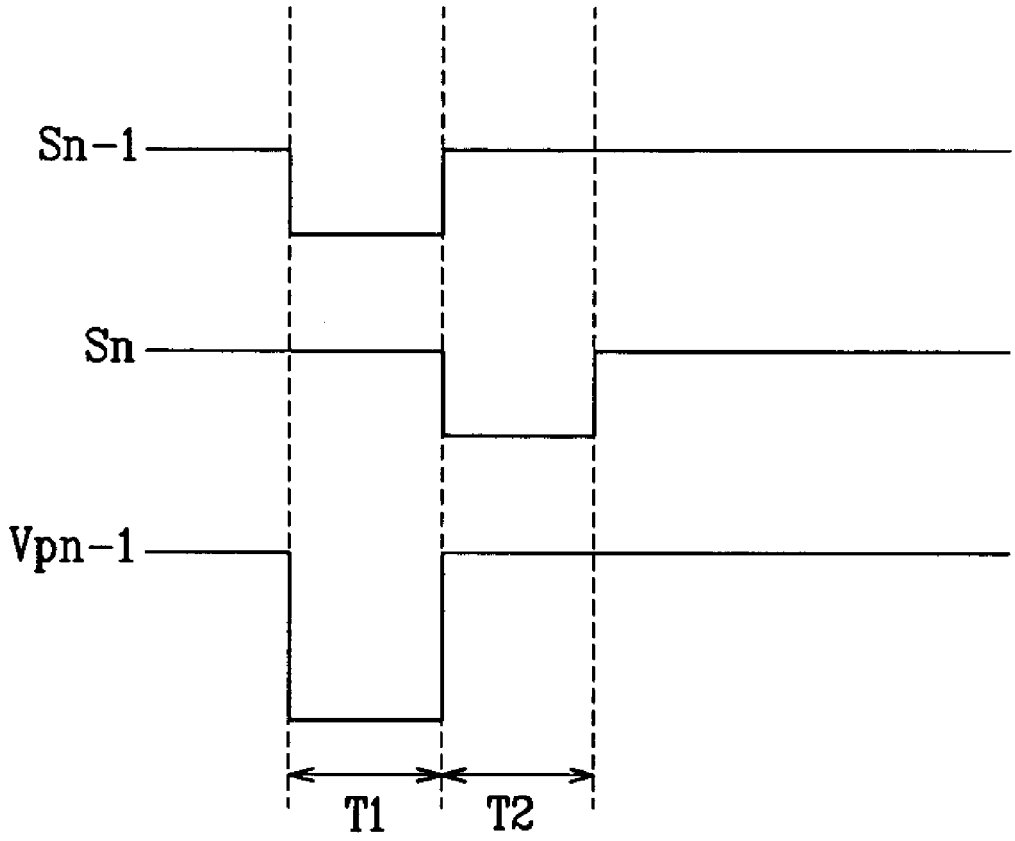
FIG. 6 shows a driving waveform diagram for driving the pixel circuit shown in FIG. 5.

Referring to FIG. 6, an operation of the pixel circuit will be described.

As shown in FIG. 6, when the select signal provided by the previous scan line Sn-1 becomes low level during the pre-charge period T1, the transistor M4 is turned on, and the precharge voltage Vpn-1 is transmitted to the gate of the transistor M1. In this instance, it is desirable to establish the voltage level of the precharge voltage Vpn-1 applied to the transistor M4 to be lower than the lowest level of the voltage applied to the gate of the transistor M1, that is, the data voltage applied through the data line Dm, so that the precharge voltage Vpn-1 may reach the maximum gray level. As a result, the data voltage is greater than the gate voltage of the transistor M1 when the data voltage is applied through the data line Dm. Therefore, the transistor M1 is coupled in the forward direction so that the data voltage is charged in the capacitor Cst.

Next, when the select signal provided by the current scan line Sn becomes low level during the data charging period T2, the transistor M3 is turned on, and the data voltage provided from the data line Dm is transmitted to the transistor M2 through the transistor M3. Since the transistor M2 is diode-connected, a voltage which corresponds to a difference between the data voltage and a threshold voltage $V_{TH2}$ of the transistor M2 is transmitted to the gate of the transistor M1, and the voltage is charged in the capacitor Cst and maintained for a predetermined time. The transistor M5 is turned on since the select signal provided from the previous scan line Sn-1 is high level. At this time, the voltage level of the precharge voltage Vpn-1 is changed to a high level, and it is desirable to establish the high level state of the precharge voltage Vpn-1 to be nearest the voltage applied to the gate of the driving transistor M1.

The high level state of the precharge voltage Vpn-1 is determined to be between the lowest level and the highest level of the data voltage, and it is desirably established to be a mean value of the data voltages applied to the pixel circuit. This way, the leakage current caused by the voltage difference between the source and the drain of the transistor M4 is prevented or reduced.

Next, the select signal provided by the current scan line Sn becomes high level, and the transistor M5 is turned on. In this instance, a current $I_{OLED}$ corresponding to the gate-source voltage $V_{GS}$ of the transistor M1 is supplied to the organic EL element (OLED), and the organic EL element (OLED) emits light. The current $I_{OLED}$ flowing to the organic EL element is defined as follows.

$$I_{OLED} = \frac{\beta}{2}(|V_{GS}| - |V_{TH1}|)^2 = \frac{\beta}{2}(V_{DD} - (V_{DATA} - |V_{TH2}|) - |V_{TH1}|)^2 \quad \text{Equation 1}$$

where $V_{TH1}$ is the threshold voltage of the transistor M1, $V_{DATA}$ is the data voltage from the data line Dm, and β is a constant.

For the threshold voltage $V_{TH1}$ of the transistor M1 equal to the threshold voltage $V_{TH2}$ of the transistor M2, Equation 1 can be rewritten as:

$$I_{OLED} = \frac{\beta}{2}(V_{DD} - V_{DATA})^2 \quad \text{Equation 2}$$

Accordingly, a current corresponding to the data voltage applied through the data line Dm flows to the organic EL element (OLED) irrespective of the threshold voltage $V_{TH1}$ of the transistor M1.

The leakage current caused by the precharge voltage Vpn-1 is prevented or reduced by establishing the precharge voltage Vpn-1 during the precharge period to be different from the precharge voltage Vpn-1 during other periods. Also, the transistor M2 is coupled in the forward direction by establishing the precharge voltage during the precharge process to be less than the lowest data voltage applied through the data line Dm, and establishing the precharge voltage to be a voltage between the lowest level and the highest level of the data voltage during a period wherein the precharge process is not performed, and the leakage current caused by the precharge voltage is controlled during other periods.

An additional driver for providing the precharge voltage Vpn-1 may be provided, and the precharge voltage Vpn-1 may be generated by adding a level shifter to the scan driver 200.

Figure 7:
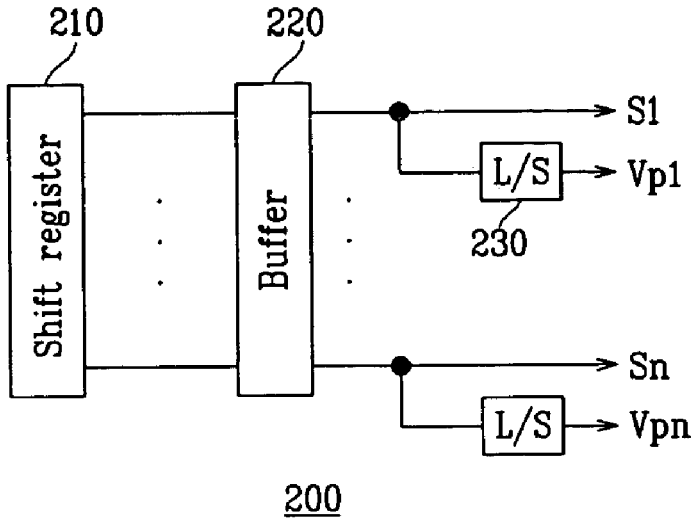
FIG. 7 shows a scan driver according to an exemplary embodiment of the present invention.

FIG. 7 shows a scan driver 200 according to an exemplary embodiment of the present invention.

As shown, the scan driver 200 includes a shift register 210, a buffer 220, and a level shifter 230. The shift register 210 sequentially shifts the applied select signals to the buffer 220. The buffer 220 compensates for reduction of operation speed caused by a load of the display panel 100. The level shifter 230 modifies levels of output signals of the buffer 220, and provides them to the pixels as precharge voltages.

In detail, the precharge voltages can be generated without an additional driving circuit by using the voltage, which is obtained by shifting the level of the select signal applied to the previous scan line Sn-1, as the precharge voltage applied to the pixel circuit coupled to the data line Dm and the scan line Sn. Hence, the scan driver 200 of FIG. 7 can be considered as including a precharge driver.

Figure 8:
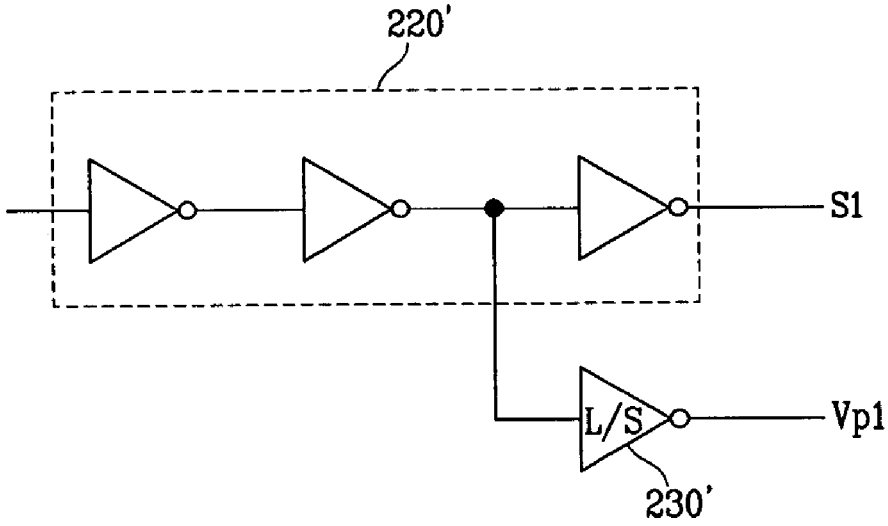
FIG. 8 shows a scan driver according to another exemplary embodiment of the present invention.

As shown in FIG. 8 as a level shift 230', the level shifter may include an inverter function, and an appropriate precharge voltage can be generated in this instance, for example, by connecting the level shifter 230' before the last inverter of a buffer 220'. Of course, the buffer 220' shown in FIG. 8 may have the same or different configuration as the buffer 220 of FIG. 7.

Figure 1:
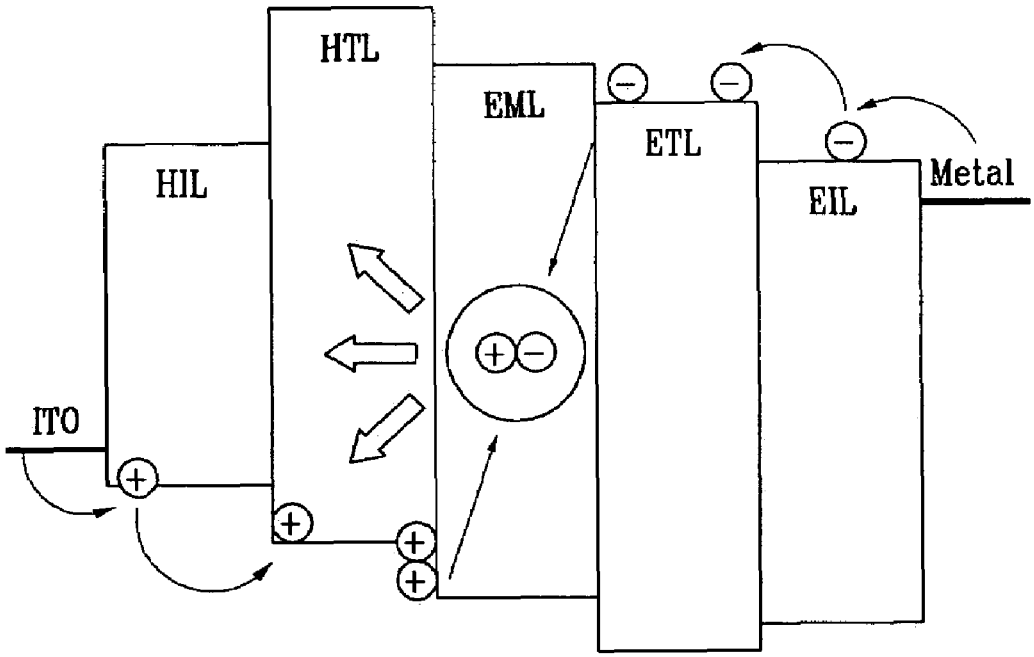
FIG. 1 shows a conceptual diagram of an organic EL element.
Figure 2:
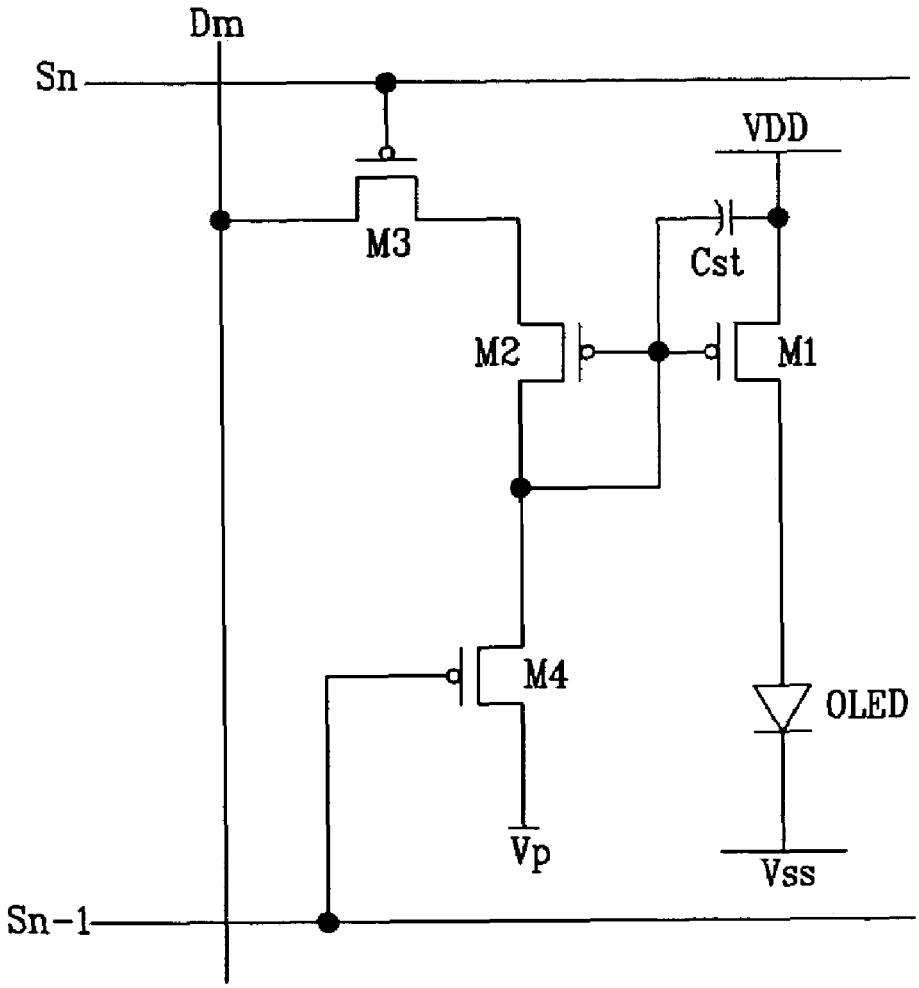
FIG. 2 shows a conventional voltage programming pixel circuit.

While this invention has been described in connection with certain exemplary embodiments, it is to be understood that the invention is not limited to the disclosed embodiments, but, on the contrary, is intended to cover various modifications included within the spirit and scope of the appended claims, and equivalents thereof. Also, the principles of the exemplary embodiment are not restricted to the pixel circuits shown in FIGS. 4 and 5, but may also be applicable to the conventional pixel circuit shown in FIG. 2.

What is claimed is:

1. A display panel of an image display device including a plurality of data lines for transmitting data voltages which represent image signals, a plurality of scan lines for transmitting select signals, and a plurality of pixel circuits coupled to the data lines and the scan lines, wherein each said pixel circuit comprises:

a driver for outputting a current corresponding to a corresponding said data voltage applied from a corresponding said data line;

a display element for displaying an image corresponding to an amount of the current outputted by the driver;

a first switch for transmitting the corresponding said data voltage to the driver in response to a corresponding said select signal applied from a corresponding said scan line;

a second switch for transmitting a precharge voltage to the driver in response to a first control signal, wherein a value of the precharge voltage during a period in which the first control signal is applied to the second switch is different from the value of the precharge voltage during other periods; and a third switch for interrupting the current from the driver to the display element while the first control signal is being applied, wherein the driver comprises:

a driving transistor, coupled between a power source and the display element, for outputting the current to the display element in correspondence to the corresponding said data voltage applied to a gate;

a compensation transistor, coupled between the first switch and the second switch, being diode-connected, and having a gate coupled to the gate of the driving transistor; and a capacitor coupled between the gate and a source of the driving transistor.

2. The display panel of claim 1, wherein the driving transistor and the compensation transistor have substantially the same characteristics.

3. The display panel of claim 1, wherein the precharge voltage has a value between the lowest level and the highest level of the corresponding said data voltage during a period in which the first control signal is not applied.

4. The display panel of claim 3, wherein the precharge voltage is a mean value of the corresponding said data voltage.

5. The display panel of claim 1, wherein the precharge voltage has a voltage level which is lower than the lowest level of the corresponding said data voltage during the period in which the first control signal is applied.

6. A display panel of an image display device including a plurality of data lines for transmitting data voltages which represent image signals, a plurality of scan lines for transmitting select signals, and a plurality of pixel circuits coupled to the data lines and the scan lines, wherein each said pixel circuit comprises:

a driver for outputting a current corresponding to a corresponding said data voltage applied from a corresponding said data line;

a display element for displaying an image corresponding to an amount of the current outputted by the driver, wherein the driver is coupled between a power source and the display element;

a first switch for transmitting the corresponding said data voltage to the driver in response to a corresponding said select signal applied from a corresponding said scan line; and a second switch for transmitting a precharge voltage from a precharge power provider different from the power source to the driver in response to a first control signal, wherein a value of the precharge voltage during a period in which the first control signal is applied to the second switch is different from the value of the precharge voltage during other periods, wherein the precharge voltage has a value between the lowest level and the highest level of the corresponding said data voltage during a period in which the first control signal is not applied, and wherein each said pixel circuit further comprises a third switch for substantially electrically isolating the driver from the display element in response to the first control signal.

7. The display panel of claim 6, wherein the precharge voltage has a voltage level which is lower than the lowest level of the corresponding said data voltage during the period in which the first control signal is applied.

8. A display panel of an image display device including a plurality of data lines for transmitting data voltages which represent image signals, a plurality of scan lines for transmitting select signals, and a plurality of pixel circuits coupled to the data lines and the scan lines, wherein each said pixel circuit comprises:

a driver for outputting a current corresponding to a corresponding said data voltage applied from a corresponding said data line;

a display element for displaying an image corresponding to an amount of the current outputted by the driver;

a first switch for transmitting the corresponding said data voltage to the driver in response to a corresponding said select signal applied from a corresponding said scan line; and a second switch for transmitting a precharge voltage to the driver in response to a first control signal, wherein a value of the precharge voltage during a period in which the first control signal is applied to the second switch is different from the value of the precharge voltage during other periods, wherein each said pixel circuit further comprises a third switch for substantially electrically isolating the driver from the display element in response to the first control signal, and wherein the second and third switches include different channel type transistors.

9. The display panel of claim 8, wherein the first control signal is another said select signal applied to a previous said scan line of the corresponding said scan line coupled to the pixel circuit.

10. An image display device comprising:

a plurality of pixel circuits, each said pixel circuit including a driving circuit for outputting a current corresponding to a corresponding one of a plurality of data voltages, a display element for displaying an image corresponding to an amount of the current outputted by the driving circuit, a first switch for transmitting the corresponding one of the data voltages to the driving circuit in response to a corresponding one of a plurality of select signals applied from a corresponding one of a plurality of scan lines, a second switch for transmitting a corresponding one of a plurality of precharge voltages to the driving circuit in response to a first control signal, and a third switch for interrupting the current from the driving circuit to the display element while the first control signal is being applied;

a data driver for supplying the plurality of data voltages to the pixel circuits;

a scan driver for supplying the plurality of select signals to the pixel circuits; and a precharge driver for supplying the plurality of precharge voltages to the pixel circuits, wherein each said precharge voltage has at least two levels, and wherein the driving circuit comprises:

a driving transistor, coupled between a power source and the display element, for outputting the current to the display element in correspondence to the corresponding one of the data voltages applied to a gate;

a compensation transistor, coupled between the first and second switches, being diode-connected, and having a gate coupled to the gate of the driving transistor; and a capacitor coupled between the gate and a source of the driving transistor.

11. An image display device comprising:

a plurality of pixel circuits, each said pixel circuit including a driving circuit for outputting a current corresponding to a corresponding one of a plurality of data voltages, a display element for displaying an image corresponding to an amount of the current outputted by the driving circuit, a first switch for transmitting the corresponding one of the data voltages to the driving circuit in response to a corresponding one of a plurality of select signals applied from a corresponding one of a plurality of scan lines, and a second switch for transmitting a corresponding one of a plurality of precharge voltages to the driving circuit in response to a first control signal;

a data driver for supplying the plurality of data voltages to the pixel circuits;

a scan driver for supplying the plurality of select signals to the pixel circuits; and a precharge driver for supplying the plurality of precharge voltages to the pixel circuits, wherein each said precharge voltage has at least two levels, and wherein the precharge driver includes a level shifter for receiving a signal which corresponds to a previous one of the select signals output by the scan driver, and outputting the corresponding one of the precharge voltages.

12. An image display device comprising:

a plurality of pixel circuits, each said pixel circuit including a driving circuit for outputting a current corresponding to a corresponding one of a plurality of data voltages, a display element for displaying an image corresponding to an amount of the current outputted by the driving circuit, a first switch for transmitting the corresponding one of the data voltages to the driving circuit in response to a corresponding one of a plurality of select signals applied from a corresponding one of a plurality of scan lines, and a second switch for transmitting a corresponding one of a plurality of precharge voltages to the driving circuit in response to a first control signal;

a data driver for supplying the plurality of data voltages to the pixel circuits;

a scan driver for supplying the plurality of select signals to the pixel circuits; and a precharge driver for supplying the plurality of precharge voltages to the pixel circuits, wherein each said precharge voltage has at least two levels, wherein the precharge driver is formed within the scan driver, and wherein the scan driver comprises:

a shift register for sequentially shifting the select signals, storing them, and providing them as output signals;

a buffer for receiving the output signals provided by the shift register and applying them to the scan lines, the buffer including at least two inverters; and a level shifter for modifying a voltage level of an input signal of a last one of said at least two inverters, and providing the modified voltage level to a corresponding said pixel circuit as the corresponding one of the precharge voltages.

13. The image display device of claim 12, wherein the level shifter modifies the voltage level of the input signal so that a low level of the corresponding one of the precharge voltages is lower than the lowest level of the corresponding one of the data voltages.

14. The image display device of claim 12, wherein the level shifter modifies the voltage level of the input signal so that the high level of the corresponding one of the precharge voltages is between the lowest level and the highest level of the corresponding one of the data voltages.

15. An image display device including a plurality of pixel circuits, each said pixel circuit comprising:

a display element for emitting light corresponding to an amount of current applied thereto;

a driving transistor coupled between a power source and the display element for providing the current to the display element corresponding to a data voltage applied to a gate;

a capacitor coupled between the gate of the driving transistor and the power source;

a switching transistor for providing a data voltage to the gate of the driving transistor in response to a current select signal applied to its gate;

a diode-connected compensation transistor coupled between the switching transistor and a precharge voltage source and having a gate coupled to the gate of the driving transistor; and a precharge transistor coupled between the compensation transistor and the precharge voltage source for applying a precharge voltage to the gate of the driving transistor in response to a previous select signal, wherein the precharge voltage has a first value while the precharge transistor is turned on, which is different from a second value of the precharge voltage while the precharge transistor is turned off, and wherein each said pixel circuit further comprises an interrupting transistor for interrupting the current from the driving transistor to the display element in response to the previous select signal.

16. An image display device including a plurality of pixel circuits, each said pixel circuit comprising:

a display element for emitting light corresponding to an amount of current applied thereto;

a driving transistor coupled between a power source and the display element for providing the current to the display element corresponding to a data voltage applied to a gate;

a capacitor coupled between the gate of the driving transistor and the power source;

a switching transistor for providing a data voltage to the gate of the driving transistor in response to a current select signal applied to its gate;

a diode-connected compensation transistor coupled between the switching transistor and a precharge voltage source and having a gate coupled to the gate of the driving transistor; and a precharge transistor coupled between the compensation transistor and the precharge voltage source for applying a precharge voltage to the gate of the driving transistor in response to a previous select signal, wherein the precharge voltage has a first value while the precharge transistor is turned on, which is different from a second value of the precharge voltage while the precharge transistor is turned off, and wherein the image display device further comprises a scan driver for providing the select signals to the pixel circuits, the scan driver comprising:

a buffer including at least two inverters arranged in series for providing the previous select signal; and a level shifter including an inverter having an input coupled to an input of the last of the at least two said inverters arranged in series, wherein the precharge voltage is an output of the level shifter.

17. An image display device comprising:

a plurality of pixel circuits, each said pixel circuit including a driving circuit for outputting a current corresponding to a corresponding one of a plurality of data voltages, a display element for displaying an image corresponding to an amount of the current outputted by the driving circuit, wherein the driving circuit is coupled between a power source and the display element, a first switch for transmitting the corresponding one of the data voltages to the driving circuit in response to a corresponding one of a plurality of select signals applied from a corresponding one of a plurality of scan lines, and a second switch for transmitting a corresponding one of a plurality of precharge voltages to the driving circuit in response to a first control signal;

a data driver for supplying the plurality of data voltages to the pixel circuits;

a scan driver for supplying the plurality of select signals to the pixel circuits; and a precharge driver for supplying the plurality of precharge voltages to the pixel circuits, the precharge driver being different from the power source, wherein each said precharge voltage has at least two levels, wherein a high level of the corresponding one of the precharge voltages is between the lowest level and the highest level of the corresponding one of the data voltages, and wherein each said pixel circuit further comprises a third switch for interrupting the current from the driving circuit to the display element while the first control signal is being applied.

18. The image display device of claim 17, wherein the precharge driver is formed within the scan driver.

19. An image display device including a plurality of pixel circuits, each said pixel circuit comprising:

a display element for emitting light corresponding to an amount of current applied thereto;

a driving transistor coupled between a power source and the display element for providing the current to the display element corresponding to a data voltage applied to a gate;

a capacitor coupled between the gate of the driving transistor and the power source;

a switching transistor for providing a data voltage to the gate of the driving transistor in response to a current select signal applied to its gate;

a diode-connected compensation transistor coupled between the switching transistor and a precharge voltage source and having a gate coupled to the gate of the driving transistor; and a precharge transistor coupled between the compensation transistor and the precharge voltage source for applying a precharge voltage to the gate of the driving transistor in response to a previous select signal, wherein the precharge voltage has a first value while the precharge transistor is turned on, which is different from a second value of the precharge voltage while the precharge transistor is turned off, wherein the second value of the precharge voltage is between the highest value and the lowest value of the data voltage, and wherein each said pixel circuit further comprises an interrupting transistor for interrupting the current from the driving transistor to the display element in response to the previous select signal.

20. The image display device of claim 19, wherein the first value of the precharge voltage is less than the lowest value of the data voltage.

* * * * *